US009945145B2

(12) United States Patent
Faries et al.

(10) Patent No.: US 9,945,145 B2
(45) **Date of Patent: *Apr. 17, 2018**

(54) EMBEDDED POLES FOR UTILITY POLES AND STRUCTURES

(71) Applicant: Trinity Meyer Utility Structures, LLC, Dallas, TX (US)

(72) Inventors: Guy L. Faries, Memphis, TN (US); Jonathan P. Girard, Collierville, TN (US); Mark H. Fairbairn, Red Wing, MN (US)

(73) Assignee: TRINITY MEYER UTILITY STRUCTURES LLC, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/597,930

(22) Filed: May 17, 2017

(65) Prior Publication Data

US 2017/0247899 A1 Aug. 31, 2017

Related U.S. Application Data

(63) Continuation-in-part of application No. 15/049,492, filed on Feb. 22, 2016, now Pat. No. 9,771,733.

(51) Int. Cl.

| | |
|---|---|
| ***E04H 12/22*** | (2006.01) |
| ***E02D 27/42*** | (2006.01) |
| ***E02D 27/50*** | (2006.01) |

(52) U.S. Cl.

CPC ..... *E04H 12/2223* (2013.01); *E02D 27/42* (2013.01); *E04H 12/2261* (2013.01); *E04H 12/2269* (2013.01)

(58) Field of Classification Search

CPC ..... E04H 12/2223; E04H 12/2269; E04H 12/223; E02D 27/50; E02D 27/42

See application file for complete search history.

(56) References Cited

U.S. PATENT DOCUMENTS

| | | | | |
|---|---|---|---|---|
| 3,011,597 | A * | 12/1961 | Galloway | E04H 12/2223 52/154 |
| 3,942,296 | A * | 3/1976 | Meyer | E02D 27/42 52/296 |
| 4,803,812 | A * | 2/1989 | Alexander, Sr. | E02D 5/801 52/157 |
| 5,516,237 | A * | 5/1996 | Hebant | E02D 27/42 405/133 |
| 6,202,368 | B1 * | 3/2001 | Wallace, III | E02D 5/801 248/156 |

(Continued)

*Primary Examiner* — Rodney Mintz

(74) *Attorney, Agent, or Firm* — Baker Botts, LLP

(57) ABSTRACT

An embedded pole installation method including applying a rotational force to a leading pole and an intermediate pole. The leading pole comprises a first helical plate disposed on a first portion of the leading pole. The intermediate pole is coupled to a second portion of the leading pole and comprises a second helical plate disposed on a first portion of the intermediate pole. The diameter of the intermediate pole is greater than a diameter of the leading pole. Applying the rotational force embeds the first helical plate and the second helical plate into a foundation such that a second portion of the intermediate pole does not penetrate the foundation. The method further includes coupling a utility pole to the second portion of the intermediate pole.

20 Claims, 11 Drawing Sheets

(56) References Cited

U.S. PATENT DOCUMENTS 6,260,314 B1 * 7/2001 Church ..... E04H 15/62 248/523
6,547,203 B1 * 4/2003 Willard ..... E04H 12/2223 248/530
6,575,853 B1 * 6/2003 O'Neill ..... A63B 63/083 473/481
6,722,821 B1 * 4/2004 Perko ..... E02D 5/801 405/249
6,743,125 B2 * 6/2004 O'Neill ..... A63B 63/083 473/481
6,958,022 B2 * 10/2005 O'Neill ..... A63B 63/083 473/479
7,413,522 B2 * 8/2008 O'Neill ..... A63B 63/083 473/479
7,575,215 B1 * 8/2009 Clark ..... A01K 97/10 248/222.11
7,637,075 B2 * 12/2009 Mitchell ..... E04H 12/003 52/170
7,736,250 B2 * 6/2010 O'Neill ..... A63B 63/083 473/479
8,156,695 B2 * 4/2012 Smith ..... E02D 5/28 52/154
8,704,089 B2 * 4/2014 Atchley ..... H02G 9/06 174/38
8,863,450 B2 * 10/2014 Anderson ..... E04H 12/345 52/117
9,057,169 B1 * 6/2015 Perko ..... E02D 5/56
9,091,037 B2 * 7/2015 Fairbairn ..... E02D 27/42
9,181,674 B2 * 11/2015 El Naggar ..... E02D 7/22
9,512,589 B1 * 12/2016 Van Polen ..... E02D 7/28
9,670,638 B2 * 6/2017 El Naggar ..... E02D 7/22
9,771,733 B2 * 9/2017 Faries ..... E04H 12/2223
2003/0159839 A1 * 8/2003 Perko ..... E02D 5/56 172/100
2004/0194400 A1 * 10/2004 Ray ..... E02D 27/42 52/169.9
2004/0221543 A1 * 11/2004 Eleas ..... E02D 5/56 52/153
2004/0266567 A1 * 12/2004 O'Neill ..... A63B 63/083 473/481
2006/0138208 A1 * 6/2006 Lackey ..... A47G 29/1216 232/39
2006/0175524 A1 * 8/2006 Nelson ..... E04H 12/2261 248/545
2007/0017166 A1 * 1/2007 Nicolet ..... E02D 5/74 52/155
2007/0181767 A1 * 8/2007 Wobben ..... E02D 27/42 248/346.01
2008/0078141 A1 * 4/2008 Mitchell ..... E04H 12/003 52/843
2008/0156957 A1 * 7/2008 Nervi ..... G09F 7/22 248/530
2008/0184633 A1 * 8/2008 Hamilton ..... E04H 12/2284 52/127.12
2009/0035070 A1 * 2/2009 Kwon ..... E02D 27/42 405/244
2009/0293379 A1 * 12/2009 Smith ..... E02D 5/28 52/154
2010/0061810 A1 * 3/2010 Breaux ..... E02D 27/50 405/228
2011/0222957 A1 * 9/2011 Marques Lito Velez Grilo ..... E02D 27/42 403/4
2012/0230004 A1 * 9/2012 Atchley ..... H02G 9/06 361/825
2012/0328374 A1 * 12/2012 El Naggar ..... E02D 7/22 405/233
2013/0227897 A1 * 9/2013 Palmer ..... E02D 27/42 52/157
2014/0115978 A1 * 5/2014 Fairbairn ..... E02D 27/42 52/126.1
2014/0259832 A1 * 9/2014 Todd ..... G09F 15/0075 40/607.03
2015/0090857 A1 * 4/2015 Walker ..... E04H 12/2238 248/535
2015/0247336 A1 * 9/2015 Bergman ..... E04H 12/2223 52/157
2015/0252581 A1 * 9/2015 Perina ..... E02D 27/00 52/704
2015/0267904 A1 * 9/2015 Magargee ..... E04H 12/003 362/431
2016/0024739 A1 * 1/2016 Kelleher ..... E04H 12/223 405/232
2016/0060838 A1 * 3/2016 El Naggar ..... E02D 7/22 405/241
2017/0241154 A1 * 8/2017 Faries ..... E02D 27/42

* cited by examiner

EMBEDDED POLES FOR UTILITY POLES AND STRUCTURES

CROSS-REFERENCE TO RELATED APPLICATIONS

The present application is a continuation in part of U.S. Non-Provisional patent application Ser. No. 15/049,492 filed Feb. 22, 2016 by Guy L. Faries, et al., and entitled "EMBEDDED POLES FOR UTILITY POLES AND STRUCTURES," which is incorporated herein by reference as if reproduced in its entirety.

TECHNICAL FIELD

This disclosure relates generally to embedded pole systems, and more specifically to systems and methods for installing utility poles into a foundation.

BACKGROUND

Installing embedded poles into a foundation (e.g. the ground) can be costly and time consuming. Existing embedded pole systems first require a hole to be dug into the ground which creates spoils as the hole is dug. The embedded pole system is then installed into the ground and the spoils that were created are backfilled into the ground to secure the embedded pole. Additional material such as concrete or grout may also be introduced into the ground to secure the embedded pole system within the ground. Backfilling and adding additional material to secure the embedded pole system introduces costs and delays to the embedded pole system installation. It is desirable to provide an embedded pole system that reduces the need for backfilling and using additional materials for securing an embedded pole into the ground.

SUMMARY

In one embodiment, the disclosure includes an embedded pole installation method comprising applying a rotational force to a leading pole and an intermediate pole. The leading pole comprises a first helical plate disposed on a first portion of the leading pole. The intermediate pole is coupled to a second portion of the leading pole and comprises a second helical plate disposed on a first portion of the intermediate pole. The diameter of the intermediate pole is greater than a diameter of the leading pole. Applying the rotational force embeds the first helical plate and the second helical plate into a foundation such that a second portion of the intermediate pole does not penetrate the foundation. The method further comprises coupling a utility pole to the second portion of the intermediate pole.

In another embodiment, the disclosure includes an embedded pole system comprising a leading pole and an intermediate pole. The leading pole comprises a first helical plate disposed on a first portion of the leading pole. The intermediate pole is coupled to a second portion of the leading pole and comprises a second helical plate disposed on a first portion of the intermediate pole. The diameter of the intermediate pole is greater than a diameter of the leading pole.

Various embodiments present several technical advantages, such as an embedded pole system that allows for a quick installation of a utility pole with a pole into the ground without the need for backfilling or introducing additional materials (e.g. cement) into the ground. The pole uses a helical plate that allows the pole to be installed firmly secured into the ground while producing little to no spoils. The utility pole may be integrated with the pole once the pole is installed in the ground, which simplifies the installation process and reduces the time and costs associated with installing an embedded poles system.

Certain embodiments of the present disclosure may include some, all, or none of these advantages. These advantages and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Disclosed herein are various embodiments for providing an embedded pole system that allows utility poles to be installed without needing to backfill or use additional material (e.g. cement) to secure the embedded pole system and the utility pole. The embedded pole system uses one or more helical plates to embed (e.g. screw) a first portion of a pole into a foundation (e.g. the ground) such that a second portion of the pole does not penetrate the foundation. The utility pole may then be installed onto the second portion of the pole. In one embodiment, the utility pole may use a slip joint or friction between an interior surface of the utility pole and an exterior surface of the pole to couple the utility pole to the pole. Additional details for coupling the utility pole and the pole using friction are discussed in FIGS. 1 and 2. In another embodiment, the utility pole and the pole are coupled together using base plates that are disposed onto the pole and the utility pole. Additional details for coupling the utility pole and the pole using base plates are discussed in FIG. 3.

Figure 1:
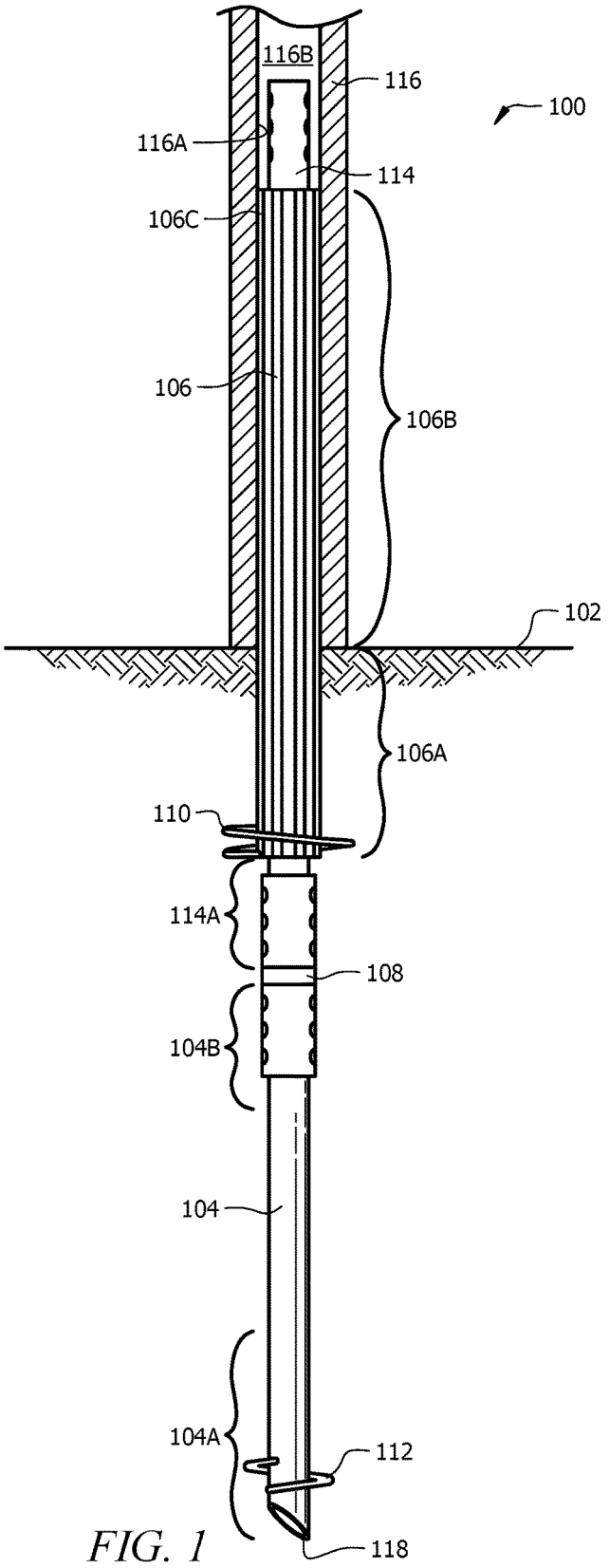
FIG. 1 is a schematic diagram of an embodiment of an embedded pole system with a leading pole.

FIG. 1 is a schematic diagram of an embodiment of an embedded pole system 100 with a leading pole 104. The embedded pole system 100 comprises the leading pole 104 coupled to an intermediate pole 106. The intermediate pole 106 is configured to couple to and support a utility pole 116. The embedded pole system 100 may be configured such that the leading pole 104 and a first portion 106A of the intermediate pole 106 are disposed within a foundation (e.g. the ground) 102 and such that a second portion 106B of the intermediate pole 106 is coupled to the utility pole 116 above the surface of the foundation 102 and does not penetrate the foundation 102. For example, the leading pole 104 and the first portion 106A of the intermediate pole 106 may be embedded or screwed into the ground when a rotational force is applied to the intermediate pole 106. The utility pole 116 and the second portion 106B of the intermediate pole 106 may be configured to extend out of the ground.

The intermediate pole 106 is a tubular pole with a helical plate 110 disposed on the first portion 106A of the intermediate pole 106. The helical plate 110 may be welded, bonded, or formed onto the intermediate pole 106. The helical plate 110 may comprise any suitable number of helices and any suitable diameter of helices as would be appreciated by one of ordinary skill in the art upon viewing this disclosure. The intermediate pole 106 is configured to embed the helical plate 110 into the foundation 102 by applying a rotational force to the intermediate pole 106. In one embodiment, the intermediate pole 106 is a tapered multi-sided pole, for example, a 12-sided pole. The outer surface 106C of the second portion 106B of the intermediate pole 106 is configured to mate with or engage an inner surface 116A of the utility pole 116. For example, the outer surface 106C of the intermediate pole 106 is configured to engage the inner surface 116A of the utility pole 116, which couples the intermediate pole 106 and the utility pole 116 using the friction between the outer surface 106C and the inner surface 116A to form a slip joint between the intermediate pole 106 and the utility pole 116. In one embodiment, the intermediate pole 106 and the utility pole 116 may be coupled together using a hydraulic jack to forcibly couple the intermediate pole 106 and the utility pole 116 together. In one embodiment, the intermediate pole 106 is tapered such that the diameter of the intermediate pole 106 at the first portion 106A is greater than the diameter of the intermediate pole 106 at the second portion 106B.

The utility pole 116 is a tubular pole, for example, a tapered tubular pole. In one embodiment, the utility pole 116 is a tapered multi-sided pole, for example, a 12-sided pole. An example of the utility pole 116 includes, but is not limited to, an electric power transmission pole. The utility pole 116 may be formed of a metal (e.g. steel), a composite (e.g. fiberglass), or any other suitable material as would be appreciated by one of ordinary skill in the art upon viewing this disclosure. In an embodiment, the utility pole 116 may be configured to support overhead power lines and/or other public utilities such as cables, fiber optic cables, telephone lines, transformers, and street lights. The utility pole 116 is configured to be positioned and disposed onto the outer surface 106C of the second portion 106B of the intermediate pole 106 such that at least a portion of the intermediate pole 106 is within a recess defined by the utility pole 116, for example, the bore 116B of the utility pole 116. The recess defined by the utility pole 116 may be configured to correspond with the second portion 106B of the intermediate pole 106. For example, the recess may be configured to be multi-sided and to align or mate with the outer surface 106C of the second portion 106B of the intermediate pole 106. The recess may be configured with any suitable shape or dimensions to engage with the second portion 106B of the intermediate pole 106 as would be appreciated by one of ordinary skill in the art upon viewing this disclosure.

In one embodiment, the intermediate pole 106 includes an inner sleeve 114 that is disposed longitudinally within in the intermediate pole 106 in a recess defined by the intermediate pole 106, for example, the bore of the intermediate pole 106. The inner sleeve 114 is a tubular pole. The inner sleeve 114 may be coupled to intermediate pole 106 using a welded plate (not shown), welds, bolts, or any other mechanism for coupling the inner sleeve 114 to the intermediate pole 106 as would be appreciated by one of ordinary skill in the art upon viewing this disclosure. The inner sleeve 114 is configured such that at least a first portion 114A of the inner sleeve 114 is not enclosed within the recess (e.g. the bore) of the intermediate pole 106. The first portion 114A of the inner sleeve 114 may be configured to couple to the leading pole 104, which is described in more detail below.

In one embodiment, the leading pole 104 is a tubular pole or sleeve with a helical plate 112 disposed on a first portion 104A of the leading pole 104. The leading pole 104 has a diameter that is less than the diameter of the intermediate pole 106. Examples of the leading pole 104 include, but are not limited to, a screw pile and a helical pile. The helical plate 112 may be welded, bonded, or formed onto the leading pole 104. The helical plate 112 may comprise any suitable number of helices and any suitable diameter of helices as would be appreciated by one of ordinary skill in the art upon viewing this disclosure. The leading pole 104 is configured to embed the helical plate 112 into the foundation 102 by applying a rotational force to the leading pole 104, for example, via the intermediate pole 106. In one embodiment, the leading pole 104 may have an angled cut or pile toe at the first portion 104A of the leading pole 104. The leading pole 104 is configured to be coupled to the intermediate pole 106 via the first portion 114A of the inner sleeve 114 at a second portion 104B of the leading pole 104, which is described in more detail below.

In one embodiment, the leading pole 104 is coupled to the first portion 114A of the inner sleeve 114 using a coupler 108, for example, a removable coupler. An example of a coupler 108 includes, but is not limited to, a tubular pole with a diameter that is greater than the diameter of the first portion 114A of the inner sleeve 114 and the diameter of the second portion 104B of the leading pole 104. The coupler 108 may be configured to attach to and couple the second portion 104B of the leading pole 104 and a first portion 114A of the inner sleeve 114 using one or more fasteners. Examples of fasteners include, but are not limited to, bolts, screws, and clamps. In another embodiment, the leading pole 104 may be coupled to the first portion 114A of the inner sleeve 114 using a fixed connection, for example, a weld or bond. In another embodiment, the second portion 104B of the leading pole 104 and a first portion 114A of the inner sleeve 114 are coupled together using a plurality of couplers 108 and pole extensions (not shown) to extend the length of the leading pole 104.

Figure 2:
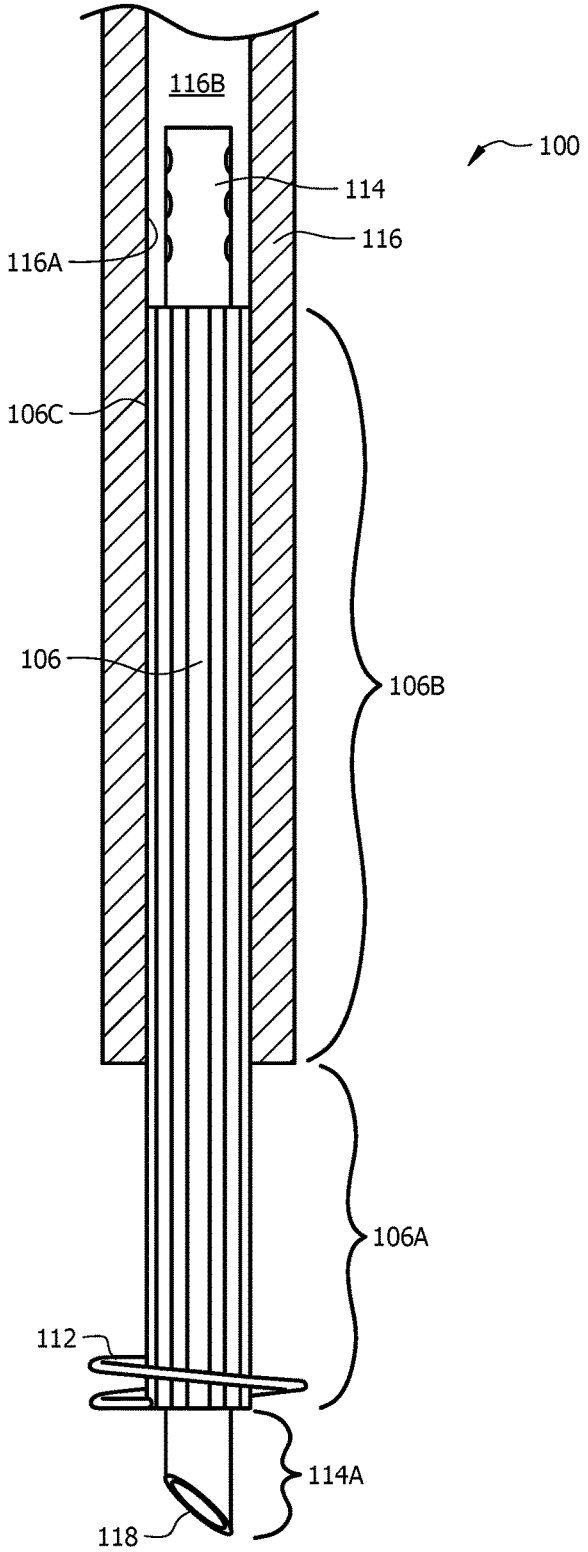
FIG. 2 is a schematic diagram of an embodiment of an embedded pole system without a leading pole.

FIG. 2 is a schematic diagram of an embodiment of an embedded pole system 100 without the leading pole 104. The embedded pole system 100 comprises an intermediate pole 106 and an inner sleeve 114. The intermediate pole 106 and the inner sleeve 114 may be configured similarly to as described in FIG. 1. The embedded pole system 100 may be configured such that the first portion 114A of the inner sleeve 114 and the first portion 106A of the intermediate pole 106 are disposed within a foundation 102 and such that the second portion 106B of the intermediate pole 106 is coupled to the utility pole 116 above the surface of the foundation 102. The second portion 106B of the intermediate pole 106 and the utility pole 116 do not penetrate the foundation 102. The outer surface 106C of the second portion 106B of the intermediate pole 106 is configured to mate with or engage the inner surface 116A of the utility pole 116. For example, the outer surface 106C of the intermediate pole 106 is configured to engage the inner surface 116A of the utility pole 116, which couples the intermediate pole 106 and the utility pole 116 using the friction between the outer surface 106C and the inner surface 116A to form a slip joint between the intermediate pole 106 and the utility pole 116. The utility pole 116 may be configured similarly to as described in FIG. 1. In FIG. 2, the inner sleeve 114 has an angled cut or pile toe at the first portion 114A of the inner sleeve 114.

Figure 3:
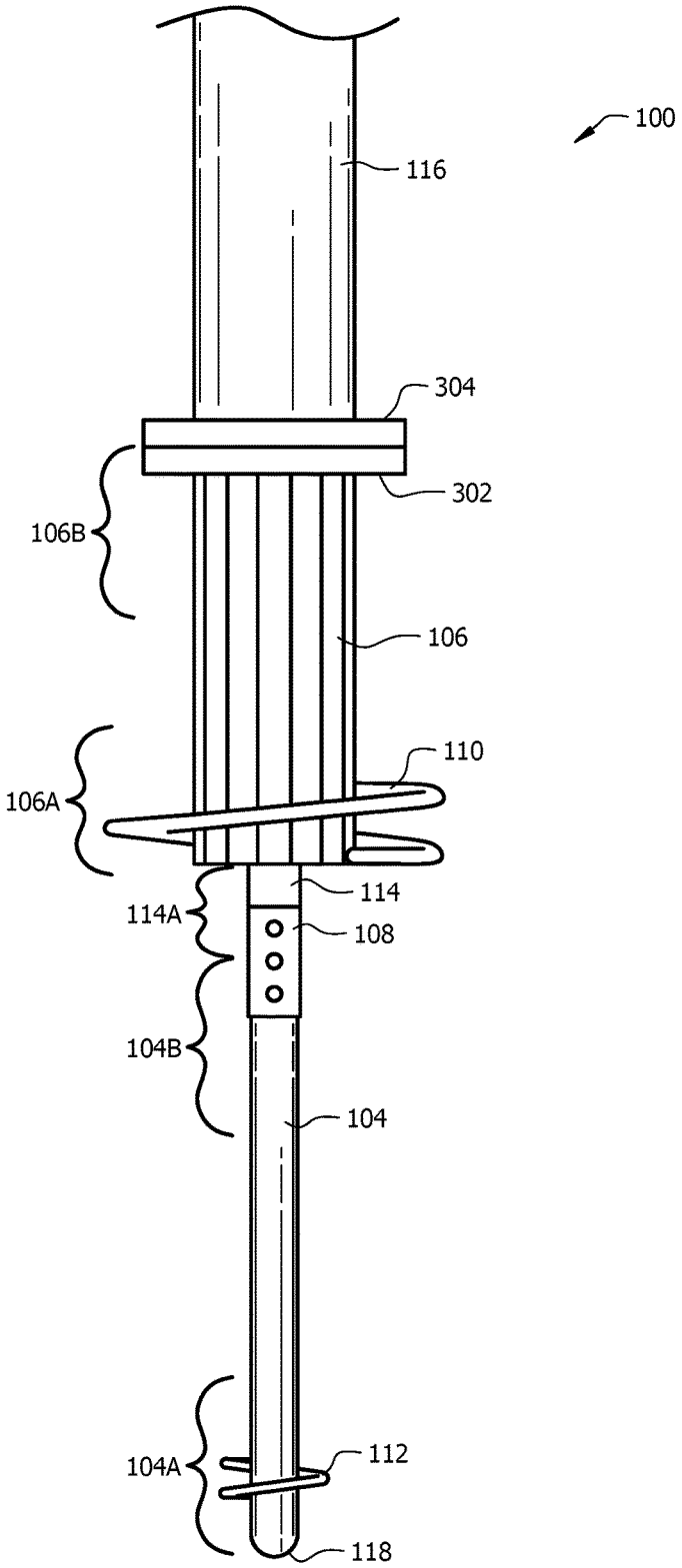
FIG. 3 is a schematic diagram of an embodiment of an embedded pole system with base plates.

FIG. 3 is a schematic diagram of an embodiment of an embedded pole system 100 using base plates 302 and 304. The embedded pole system 100 comprises an intermediate pole 106, an inner sleeve 114, a leading pole 104, and a coupler 108. The intermediate pole 106, an inner sleeve 114, a leading pole 104, and a coupler 108 may be configured similarly to as described in FIG. 1. The embedded pole system 100 may be configured such that the first portion 114A of the inner sleeve 114, the first portion 106A of the intermediate pole 106, and the leading pole 104 are disposed within a foundation 102 and such that the second portion 106B of the intermediate pole 106 is coupled to the utility pole 116 above the surface of the foundation 102. The second portion 106B of the intermediate pole 106 and the utility pole 116 do not penetrate the foundation 102. The utility pole 116 may be configured similarly to as described in FIG. 1. The second portion 106B of the intermediate pole 106 comprises base plate 302 that is configured to mate with or engage a base plate 304 that is disposed on the utility pole 116. In one embodiment, the base plate 302 may be a driving head that may be used to screw the intermediate pole 106 into the foundation 102. A driving head is described in more detail in FIG. 5. The base plates 302 and 304 may be coupled together using one or more fasteners, for example, bolts, screws, a coupler, or clamps. In one embodiment, base plates 302 and 304 may be coupled together using a breakaway type fastener that allows the fasteners to shear upon impact and to uncouple base plates 302 and 304 and thereby uncouple the utility pole 116 from the intermediate pole 106. In another embodiment, base plates 302 and 304 may be coupled together using a fixed connection, for example, a weld or bond.

Figure 4:
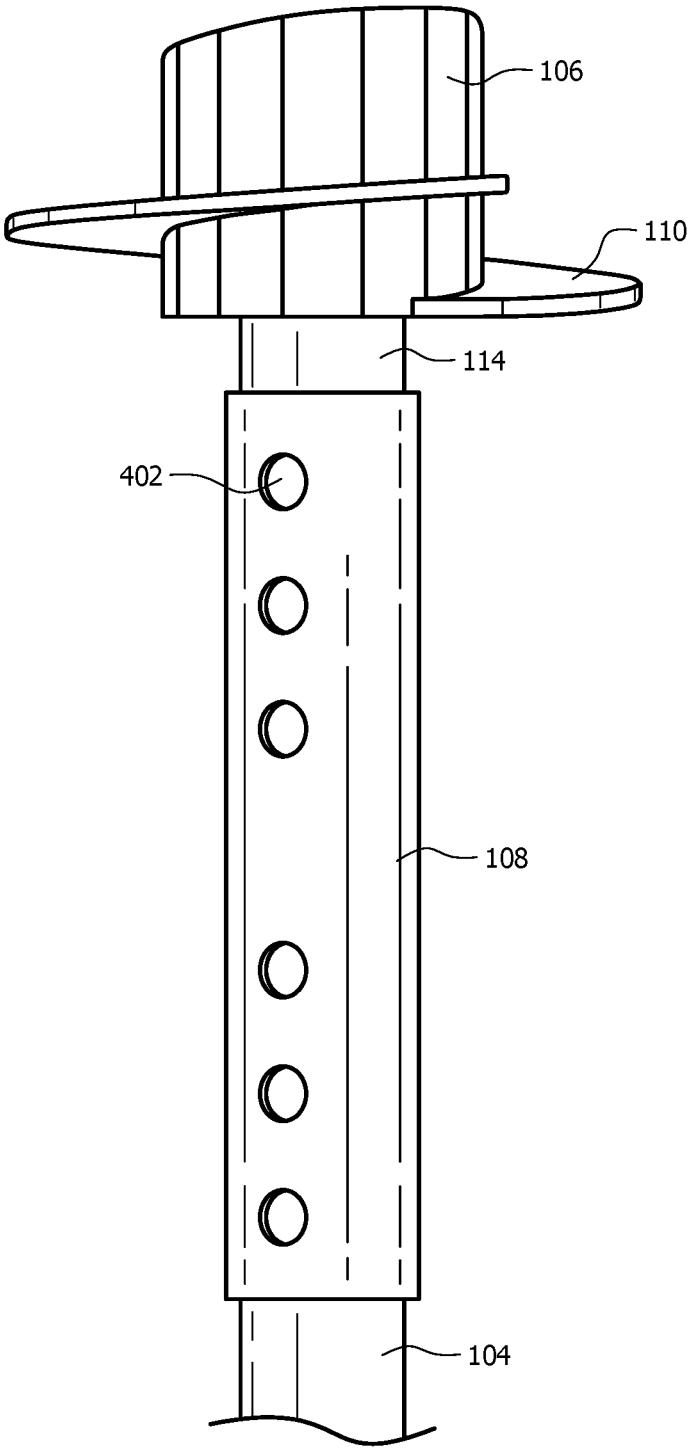
FIG. 4 is a schematic diagram of an embodiment of a coupler for an embedded pole system.

FIG. 4 is a schematic diagram of an embodiment of a coupler 108 for an embedded pole system 100. The coupler 108 may be configured similarly to as described in FIG. 1. The coupler 108 is configured to couple the leading pole 104 the inner sleeve 114. In FIG. 4 the coupler 108 is a tubular pole with a diameter that is greater than the diameter of the inner sleeve 114 and the diameter of the leading pole 104. The coupler 108 may comprise a plurality of holes or slots 402 that allow the coupler 108 to be fastened (e.g. bolted) to the leading pole 104 and the inner sleeve 114. The plurality of slots 402 may provide flexibility for coupling to the leading pole 104 and the inner sleeve 114 and/or increased support when coupling to the leading pole 104 and the inner sleeve 114. For example, the plurality of slots 402 may allow multiple fasteners to be used to couple to the leading pole 104 and the inner sleeve 114 to increase support. Other embodiments may employ similar or different coupling mechanisms.

Figure 5:
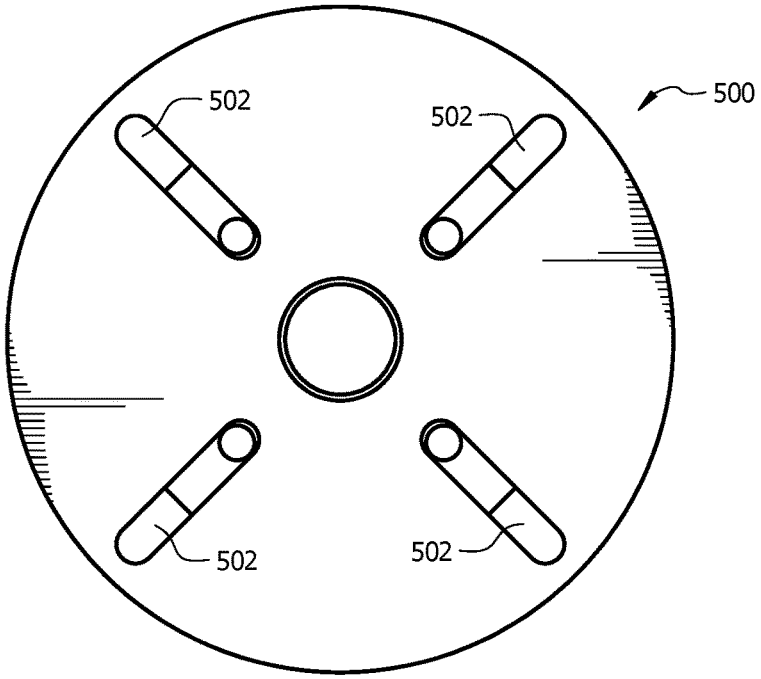
FIG. 5 is a top view of an embodiment of a driving head for an embedded pole system.

FIG. 5 is a top view of an embodiment of a driving head 500 for an embedded pole system 100. The driving head 500 may be coupled to the intermediate pole 106 and/or the inner sleeve 114 to screw the intermediate pole 106 into the foundation 102. In FIG. 5, the driving head 500 has a circular shape. Alternatively, the driving head 500 may be any other suitable shape. In one embodiment, the driving head 500 may be removably coupled to the intermediate pole 106 or the inner sleeve 114. For example, the driving head 500 may be coupled to the intermediate pole 106 or inner sleeve 114 via a base plate 302. The driving head 500 may comprise one or more holes or slots 502 that allow the driving head 500 to be installed (e.g. bolted) onto the intermediate pole 106, the inner sleeve 114, or base plate 302. In another embodiment, the driving head 500 may be fixed to or integrated with the intermediate pole 106 or the inner sleeve 114. For example, the driving head 500 may be configured as a base plate 302 disposed on the intermediate pole 106. When the driving head 500 is configured as the base plate 302, the driving head 500 may be used to couple the intermediate pole 106 to the base plate 304 of the utility pole 116.

Figure 6:
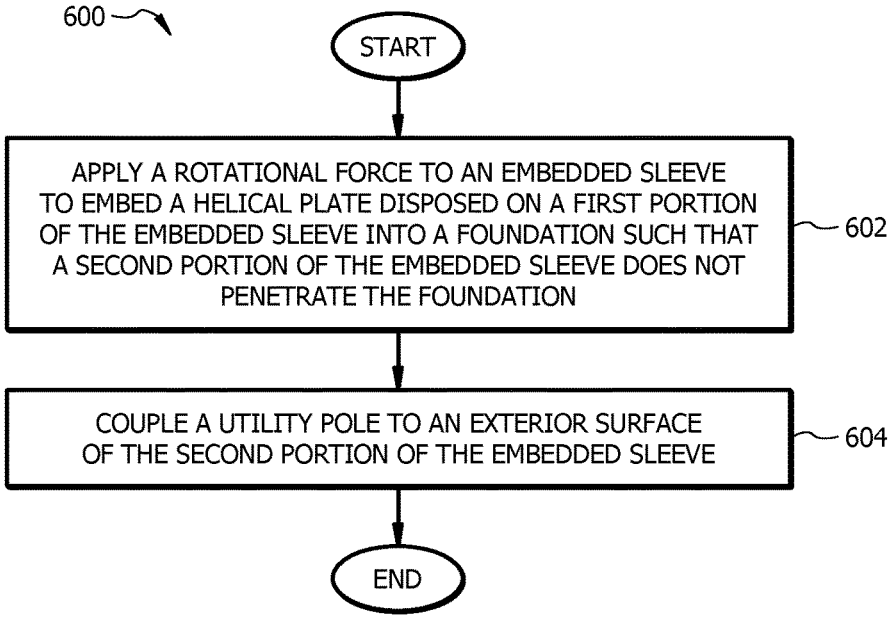
FIG. 6 is a flowchart of an embodiment of an embedded pole installation method for an embedded pole system.

FIG. 6 is a flowchart of an embodiment of an embedded pole installation method 600 for an embedded pole system 100. Method 600 may be implemented by a technician or an installer to install and secure the embedded pole system 100 into a foundation (e.g. the ground). For example, a technician may implement method 600 to install the embedded pole system 100 into the ground at a work location to support the utility pole 116 (e.g. an electrical power transmission pole). The technician may obtain and assemble the embedded pole system 100, which may be configured similarly to the embedded pole system 100 described in FIGS. 1-3.

At step 602, the technician applies a rotational force to the intermediate pole 106 to embed (e.g. screw) the helical plate 110 that is disposed on the first portion 106A of the intermediate pole 106 into the foundation 102. The technician may apply the rotational force to the intermediate pole 106 by rotating a driving head 500 that is coupled to the intermediate pole 106 or using any other suitable technique as would be appreciated by one of ordinary skill in the art upon viewing this disclosure. The intermediate pole 106 is positioned such that the second portion 106B of the intermediate pole 106 does not penetrate the foundation 102. In other words, the first portion 106A of the intermediate pole 106 is screwed into the foundation 102 to a suitable depth that also allows the second portion 106B of the intermediate pole 106 to remain uncovered by the foundation 102. When the embedded pole system 100 is configured with the leading pole 104 coupled the intermediate pole 106, the rotational force that is applied to the intermediate pole 106 is also applied to the leading pole 104, which embeds (e.g. screws) the helical plate 112 that is disposed on the first portion 104A of the leading pole 104 into the foundation 102. The rotational force may be applied to embed the intermediate pole 106 and the leading pole 104 into the foundation 102 to any suitable depth as would be appreciated by one of ordinary skill in the art upon viewing this disclosure.

At step 604, the technician couples the utility pole 116 to the exterior surface 106C of the second portion 106B of the intermediate pole 106. In one embodiment, the utility pole 116 is positioned and disposed onto the outer surface 106C of the second portion 106B of the intermediate pole 106 such that at least a portion of the intermediate pole 106 is within the bore 116B of the utility pole 116. The friction between the outer surface 106C and the inner surface 116A forms a slip joint that couples the intermediate pole 106 and the utility pole 116 together. For example, the intermediate pole 106 and the utility pole 116 may be coupled together similarly to as shown in FIGS. 1 and 2.

In another embodiment, when the intermediate pole 106 is configured with the base plate 302 and the utility pole 116 is configured with the base plate 304, the utility pole 116 is positioned or disposed on the second portion 106B of the intermediate pole 106 such that the base plate 304 is mated with or engages the base plate 302. Base plates 302 and 304 are then coupled together using fastener or a fixed connection to couple the intermediate pole 106 to the utility pole 116. For example, the intermediate pole 106 and the utility pole 116 may be coupled together similarly to as shown in FIG. 3.

FIGS. 7-12 illustrate various embodiments of base plates for an embedded pole system 100. The base plates are generally configured to connect an intermediate pole 106 with a utility pole 116. In one embodiment, the base plates are installed once the leading pole 104 and the intermediate pole 106 have been secured into the ground. The base plates can be adjusted (e.g. rotated) with respect to the intermediate pole 106 to provide flexibility when positioning and connecting the intermediate pole 106 with a utility pole 116. For example, the base plate may comprise a plurality of fastener holes (e.g. bolt holes) that can be aligned with corresponding fastener holes on a base plate of the utility pole 116. In this example, the base plate can be adjusted to properly orient the utility pole 116 when it connects to the intermediate pole 106.

Figure 7:
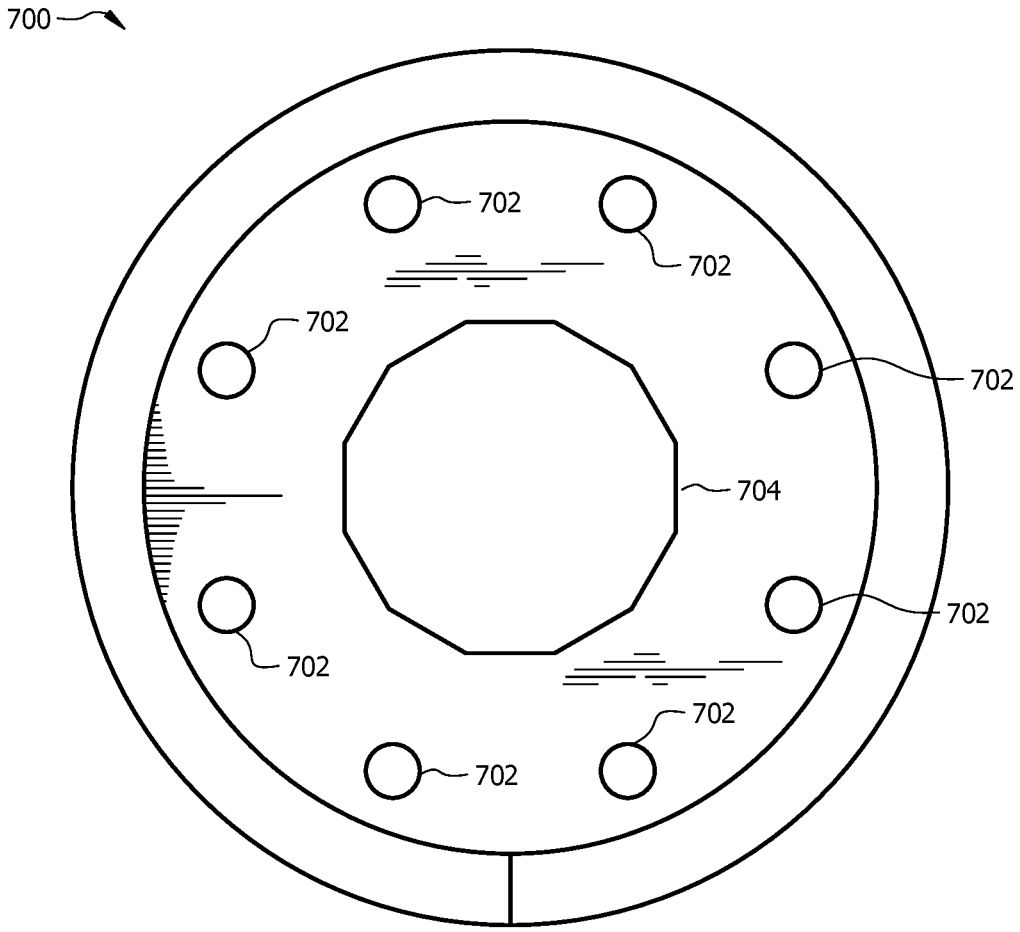
FIG. 7 is a top view of an embodiment of a slide over base plate for an embedded pole system.

FIG. 7 is a top view of an embodiment of a slide over base plate 700 for an embedded pole system 100. The base plate 700 may be formed of any suitable material, for example, steal or aluminum. The base plate 700 may be any suitable thickness as would be appreciated by one of ordinary skill in the art.

The base plate 700 comprises a plurality of fastener holes 702. In FIG. 7, the base plate 700 comprises eight fastener holes 702 in a circular configuration. In other embodiments, the base plate 700 may comprise any other suitable number and/or configuration of fastener holes 702. In one embodiment, the base plate 700 is configured with an inner diameter 704 that is greater than the outer diameter of the intermediate pole 106. In this configuration, the base plate 700 may be positioned about the exterior surface of the intermediate pole 106. In another embodiment, the base plate 700 is configured with an inner diameter that is less than the outer diameter of the intermediate pole 106. In this configuration, the base plate 700 may be coupled to the end of the intermediate pole 106.

In one embodiment, the plurality of fastener holes 702 are configured to be within the inner diameter of the intermediate pole 106. In another embodiment, the plurality of fastener holes 702 are configured to be outside of the outer diameter of the intermediate pole 106.

Figure 8:
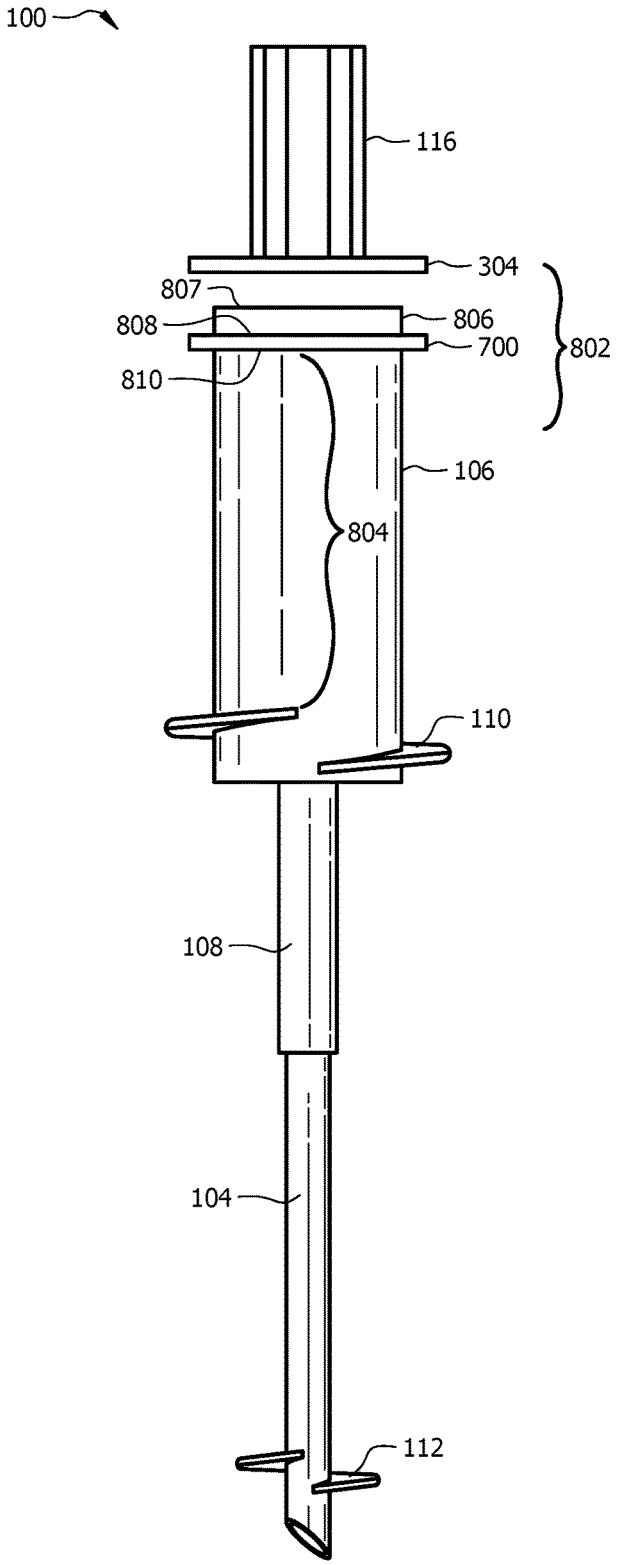
FIG. 8 is a schematic view of an embodiment an embedded pole system with a slide over base plate.

FIG. 8 is a schematic view of an embodiment an embedded pole system 100 with a slide over base plate 700. The base plate 700 is positioned and disposed about a second portion 802 of the intermediate pole 106. The base plate 700 may be rotated about the intermediate pole 106 to position the plurality of fastener holes 702 in any suitable position to mate with corresponding fastener holes of a utility pole 116. In one embodiment, once the base plate 700 is positioned, the base plate 700 is coupled to the intermediate pole 106 using a welded connection (e.g. a fillet weld). For example, the base plate 700 may be welded along a first interface 808 and/or a second interface 810 between the base plate 700 and the intermediate pole 106. In other embodiments, the base plate 700 may be coupled to the intermediate pole 106 using any other suitable type of connection or technique as would be appreciated by one of ordinary skill in the art.

In one embodiment, the base plate 700 is positioned to form a first region 804 between the base plate 700 and the second helical plate 110. The base plate 700 also forms a second region 806 between the base plate 700 and the end 807 of the intermediate pole 106. In this configuration, a space is formed between the base plate 700 and the base plate 304 of the utility pole 116 when the base plate 700 is coupled to the base plate 304 of the utility pole 116.

In another embodiment, the base plate 700 does not form the second region 806 and is instead positioned to be about flushed with the end 807 of the intermediate pole 106. In this configuration, the base plate 700 and the base plate 304 of the utility pole 116 form a flange connection and are in direct contact with each other. The connection between the base plate 700 and the base plate 304 forms a frictional connection with each other when the base plate 700 is coupled to the base plate 304 of the utility pole 116.

The base plate 700 and the base plate 304 of the utility pole 116 may be coupled together using any suitable type of fasteners. For example, the base plate 700 and the base plate 304 of the utility pole 116 may be coupled together using bolts or anchor studs. In another example, the base plate 700 and the base plate 304 of the utility pole 116 may be coupled together using a breakaway type of fastener configured to shear upon impact above a predetermined threshold. In other words, the fasteners are configured shear or break in the event that a sufficient force is applied to the utility pole 116.

In one embodiment, the thickness of the intermediate pole 106 can modified. For example, the thickness of the intermediate pole 106 can increased to provide sacrificial layers for rust and/or corrosion.

Figure 9:
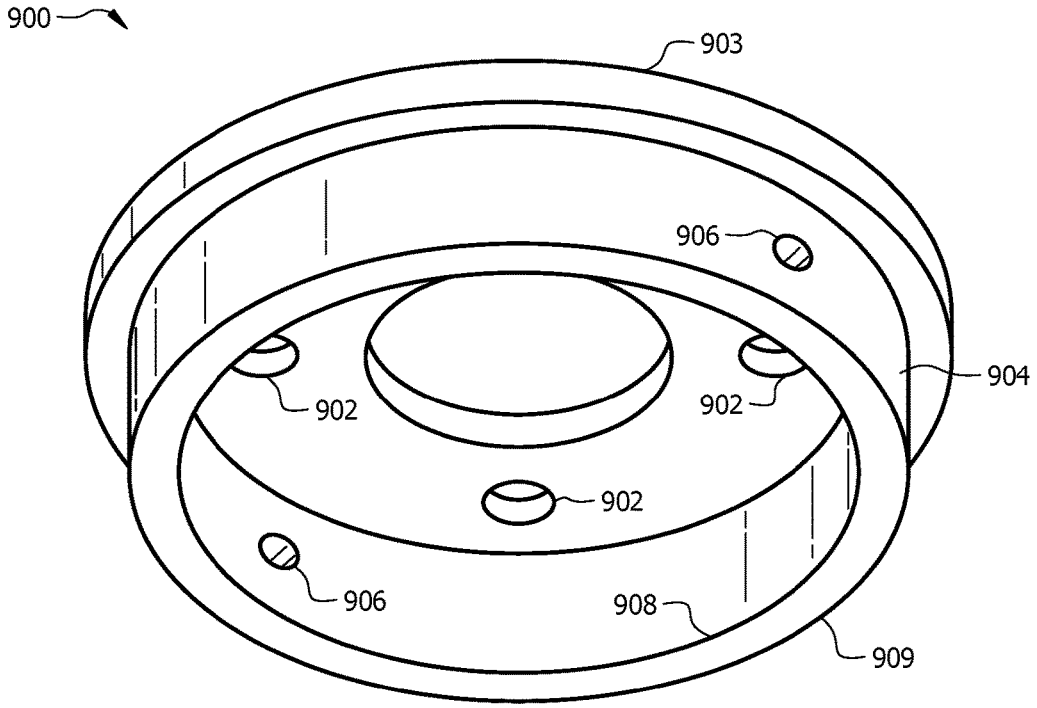
FIG. 9 is a perspective view of an embodiment of a bolt-on base plate for an embedded pole system.

FIG. 9 is a perspective view of an embodiment of a bolt-on base plate 900 for an embedded pole system 100. The base plate 900 comprises a mounting plate 903 and a collar 904. The mounting plate 903 and the collar 904 are integrated into a single structure. In one embodiment, the mounting plate 903 and the collar 904 may be coupled together using a permanent or semi-permanent connection. For example, the mounting plate 903 and the collar 904 may be welded or bolted together. In another embodiment, the mounting plate 903 and the collar 904 may be formed from a single piece of material to form the base plate 900.

The mounting plate 903 comprises a plurality of fastener holes 902. In one embodiment, the plurality of fastener holes 902 are configured to be within the inner diameter of the intermediate pole 106. In another embodiment, the plurality of fastener holes 902 are configured to be outside of the outer diameter of the intermediate pole 106. The mounting plate is generally configured to at least partially cover an end of the intermediate pole 106 and to provide an interface for connecting the intermediate pole 106 with the utility pole 116.

The collar 904 is generally configured to couple the mounting plate 903 to the intermediate pole 106. In one embodiment, the collar 904 comprises one or more fastener holes 906. In this configuration, the collar 904 may couple the mounting plate 903 to the intermediate pole 106 using bolts, pins, or any other suitable type of fasteners. In another embodiment, the collar 904 may be welded onto the intermediate pole 106.

In one embodiment, the inner diameter 908 of the collar 904 is greater than the outer diameter of the intermediate pole 106. In this configuration, the collar 904 covers at least a portion of the exterior surface of the intermediate pole 106. In another embodiment, the outer diameter 909 of the collar 904 is less than the inner diameter of the intermediate pole 106. In this configuration, the collar 904 is at least partially disposed within the inner diameter of the intermediate pole 106.

Figure 10:
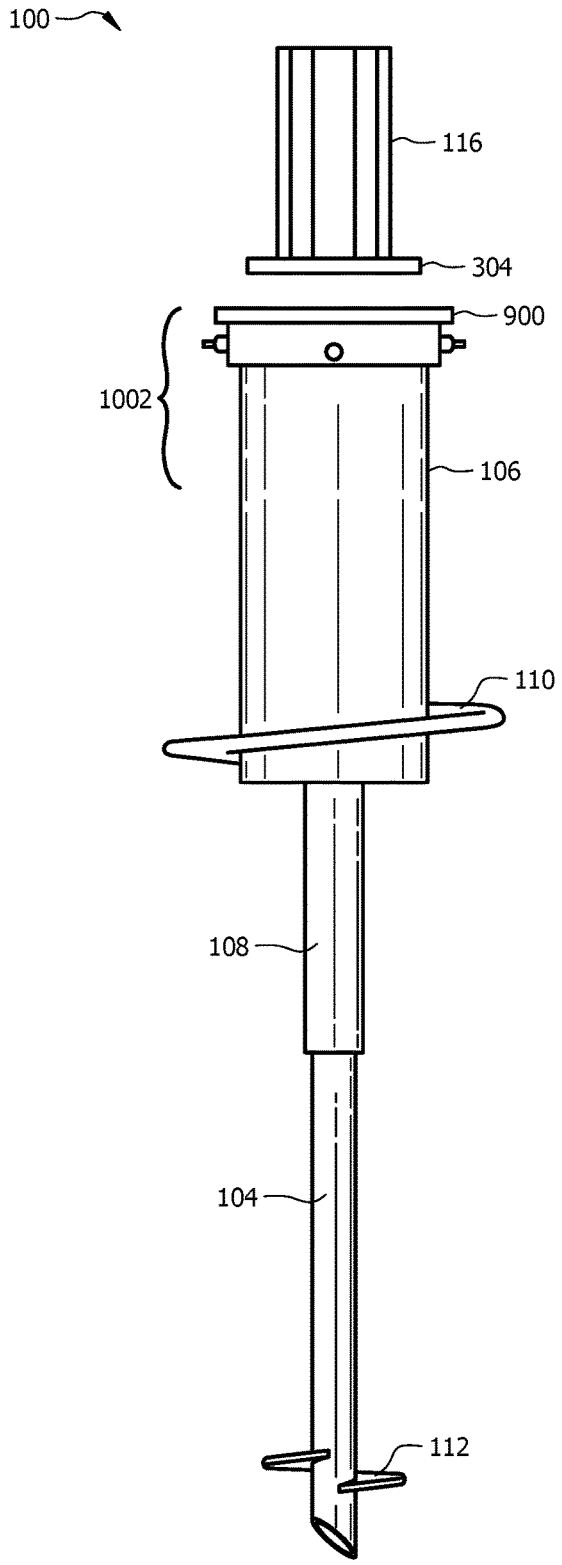
FIG. 10 is a schematic view of an embodiment an embedded pole system with a bolt-on base plate.

FIG. 10 is a schematic view of an embodiment an embedded pole system 100 with a bolt-on base plate 900. The base plate 900 is positioned and disposed about a second portion 1002 of the intermediate pole 106. In FIG. 10, the base plate 900 is configured such that the inner diameter of the couple 304 is greater than the outer diameter of the intermediate pole 106 and at least a portion of the collar 904 cover the exterior surface of the intermediate pole 106.

The base plate 900 may be rotated about the intermediate pole 106 to position the plurality of fastener holes 902 in any suitable position to mate with corresponding fastener holes of a utility pole 116. In one embodiment, once, the base plate 900 is positioned, the base plate 900 is coupled to the intermediate pole 106 using a pinned or bolted connection. In another embodiment, the base plate 900 may be coupled to the intermediate pole 106 using any other suitable type of connection or technique as would be appreciated by one of ordinary skill in the art.

The base plate 900 is configured to couple with the base plate 304 of a utility pole 116. The base plate 304 of the utility pole 116 is flushed with the lower end of the utility pole 116. The base plate 900 and the base plate 304 of the utility pole 116 are configured to be in direct contact with each other and to form a frictional connection with each other when the base plate 900 is coupled to the base plate 304 of the utility pole 116.

The base plate 900 and the base plate 304 of the utility pole 116 may be coupled together using any suitable type of fasteners. For example, the base plate 900 and the base plate 304 of the utility pole 116 may be coupled together using bolts or anchor studs. In another example, the base plate 900 and the base plate 304 of the utility pole 116 may be coupled together using a breakaway type of fastener configured to shear upon impact above a predetermined threshold.

Figure 11:
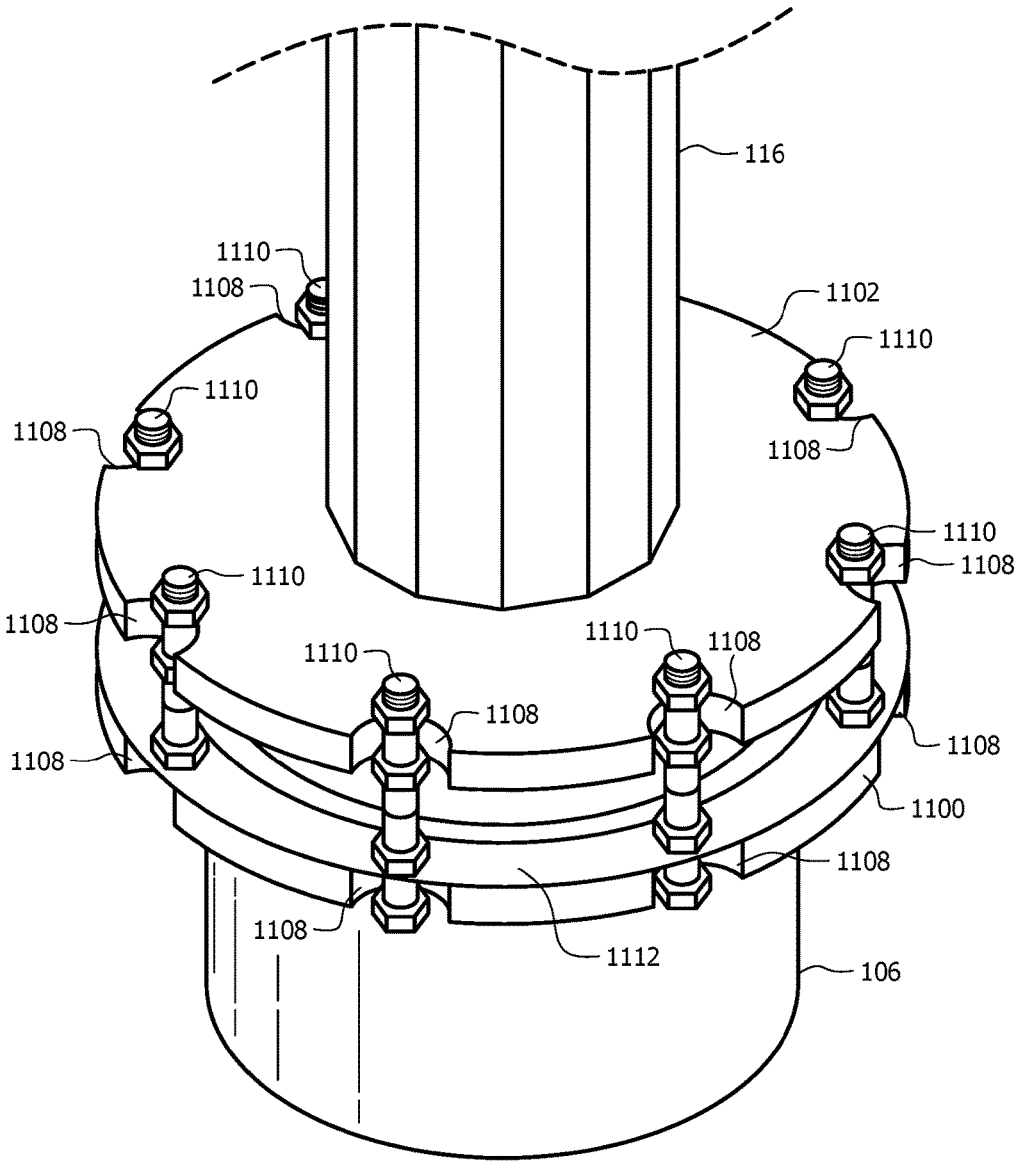
FIG. 11 is a perspective view of an embodiment of a breakaway base plate for an embedded pole system.

FIG. 11 is a perspective view of an embodiment of a breakaway base plate 1100 for an embedded pole system 100. The base plate 1100 comprises a plurality of slots 1108 disposed along the outer diameter of the base plate 1100. The base plate 1100 may comprise any suitable number of slots 1108. In one embodiment, the base plate 1100 is configured with an inner diameter that is greater than the outer diameter of the intermediate pole 106. The base plate 1100 may be formed of any suitable material and with any suitable thickness as would be appreciated by one of ordinary skill in the art.

In FIG. 11, the base plate 1100 is shown coupled to a base plate 1102 of a utility pole 116. The base plate 1102 is about flush with the lower end of the utility pole 116. The base plate 1102 also comprises a plurality of slots 1108 that correspond with the slots 1108 of the base plate 1100. The base plate 1100 and the base plate 1102 are coupled together using a plurality of fasteners 1110. In one embodiment, each fastener 1110 comprises a first pair of nuts configured to engage the slot 1108 of the base plate 1100 and a second pair of nuts configured to engage the slot 1108 of the base plate 1102. For example, each pair of nuts may be configured to apply a compressive (e.g. squeezing) force onto one of the base plates. The fasteners 1110 may further comprise washers, spacers, and/or any other suitable hardware for coupling the base plate 1100 and the base plate 1102 together. In another embodiment, the base plate 1100 and the base plate 1100 are coupled together using a breakaway type of fastener configured to shear upon impact above a predetermined threshold. In other embodiments, the base plate 1100 and the base plate 1100 are coupled together using any other suitable type of fasteners.

In one embodiment, a shear plate 1112 is disposed between the base plate 1100 and the base plate 1102. The shear plate 1112 comprises a plurality of fastener holes configured to help align and position fasteners 1110 when coupling the base plate 1100 and the base plate 1102 together. The shear plate 1112 is configured to shear or tear in response to a force above a predetermined threshold being applied to the shear plate 1112. In other words, the shear plate 1112 configured shear or break in the event that a sufficient force is applied to the utility pole 116. In one embodiment, the shear plate 1112 is formed from a metal material and is about 1/16th inches thick. In other embodiments, the shear plate 1112 may be formed from any other suitable type of material and may have any other suitable thickness.

Figure 12:
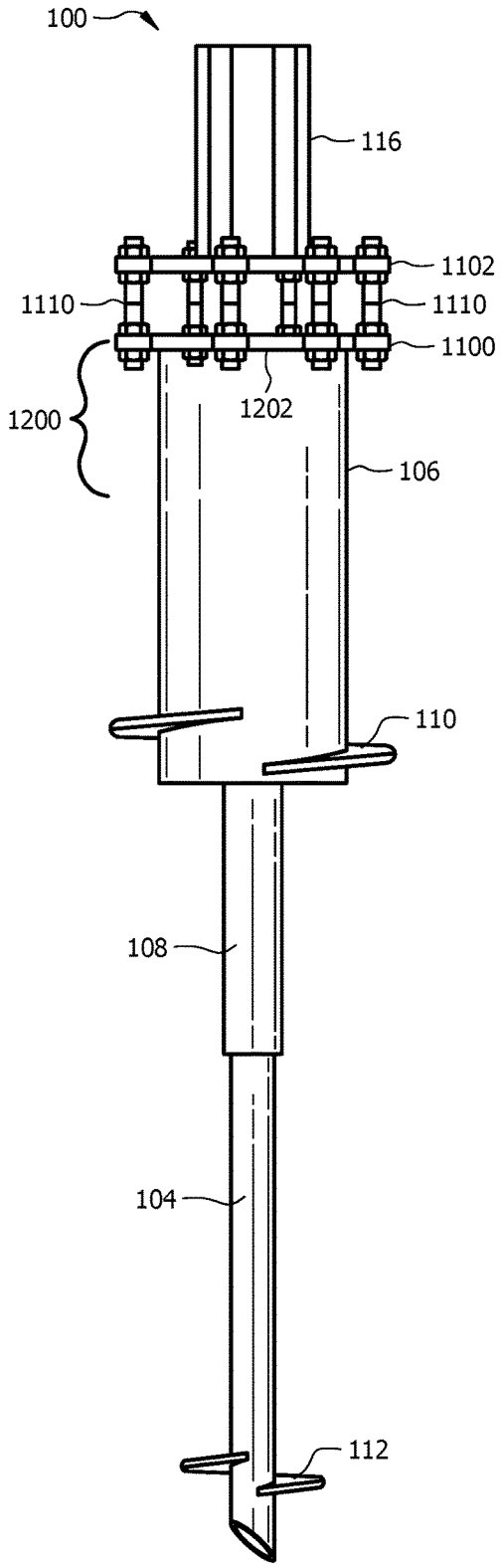
FIG. 12 is a schematic view of an embodiment an embedded pole system with a breakaway base plate.

FIG. 12 is a schematic view of an embodiment an embedded pole system 100 with a breakaway base plate 1100. The base plate 1100 is positioned and disposed about a second portion 1200 of the intermediate pole 106. The base plate 1100 may be rotated about the intermediate pole 106 to position the plurality of slots 1108 in any suitable position to mate with corresponding slots 1108 of the base plate 1102 of the utility pole 116.

In one embodiment, once the base plate 1100 is positioned, the base plate 1100 is coupled to the intermediate pole 106 using a welded connection. In other embodiments, the base plate 1100 is coupled to the intermediate pole 106 using any other suitable type of connection as would be appreciated by one of ordinary skill in the art. In one embodiment, the base plate 1100 is configured to be about flushed with the end 1202 of the intermediate pole 106.

In one embodiment, the base plate 1100 and the base plate 1102 of the utility pole 116 are not in contact with each other. In this configuration, a space is formed between the base plate 1100 and the base plate 1102 of the utility pole 116 when the base plate 1100 is coupled to the base plate 1102 of the utility pole 116. In this configuration, when a sufficient level of force is applied to the utility pole 116, the utility pole 116 will decouple from the intermediate pole 106. For example, if a vehicle hits the utility pole 116, the utility pole 116 will decouple from the base plate 1100 to reduce the amount of damage that occurs.

In another embodiment, the base plate 1100 and the base plate 1102 of the utility pole 116 are in direct contact with each other and form a frictional connection with each other when the base plate 1100 is coupled to the base plate 1102 of the utility pole 116.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

The invention claimed is:

1. An embedded pole system comprising:

a leading pole comprising a first helical plate disposed on a first portion of the leading pole;

an intermediate pole comprising a second helical plate disposed on a first portion of the intermediate pole, wherein:

the first portion of the intermediate pole is coupled to a second portion of the leading pole, an outer diameter of the intermediate pole is greater than an outer diameter of the leading pole; and a first base plate comprising a plurality of fastener holes, wherein:

the first base plate is disposed about a second portion of the intermediate pole;

the inner diameter of the first base plate is greater than the outer diameter of the intermediate pole;

the first base plate is positioned to form:

a first region between the first base plate and the second helical plate;

a second region between the first base plate and an end of the intermediate pole.

2. The system of claim 1, wherein the first base plate is welded onto the intermediate pole.

3. The system of claim 1, further comprising a utility pole comprising:

a second base plate comprising a plurality of fastener holes, wherein the second base plate is flush with an end of the utility pole, and wherein the first base plate is coupled to the second base plate using a plurality of fasteners.

4. The system of claim 3, wherein the fasteners include a breakaway feature configured to shear upon impact above a predetermined threshold.

5. The system of claim 3, wherein a surface of the first base plate is in direct contact with a surface of the second base plate.

6. The system of claim 3, wherein the utility pole is a tapered tubular pole.

7. An embedded pole system comprising:

a leading pole comprising a first helical plate disposed on a first portion of the leading pole;

an intermediate pole comprising a second helical plate disposed on a first portion of the intermediate pole, wherein:

the first portion of the intermediate pole is coupled to a second portion of the leading pole, an outer diameter of the intermediate pole is greater than an outer diameter of the leading pole; and a first base plate comprising:

a mounting plate comprising a plurality of fastener holes, wherein the mounting plate is configured to cover an end of the intermediate pole; and a collar configured to couple the mounting plate to a second portion of the intermediate pole.

8. The system of claim 7, wherein an inner diameter of the collar is greater than the outer diameter of the intermediate pole.

9. The system of claim 7, wherein:

an outer diameter of the collar is less than an inner diameter of the intermediate pole, and the collar is at least partially disposed within the inner diameter of the intermediate pole.

10. The system of claim 7, wherein the plurality of fastener holes are configured within an inner diameter of the intermediate pole.

11. The system of claim 7, wherein the plurality of fastener holes are configured outside of the outer diameter of the intermediate pole.

12. The system of claim 7, further comprising a utility pole comprising:

a second base plate comprising a plurality of fastener holes, wherein the second base plate is flush with an end of the utility pole, and wherein the first base plate is coupled to the second base plate using a plurality of fasteners.

13. The system of claim 12, wherein the fasteners include a breakaway feature configured to shear upon impact above a predetermined threshold.

14. The system of claim 12, wherein a surface of the first base plate is in direct contact with a surface of the second base plate.

15. An embedded pole system comprising:

a leading pole comprising a first helical plate disposed on a first portion of the leading pole;

an intermediate pole comprising a second helical plate disposed on a first portion of the intermediate pole, wherein:

the first portion of the intermediate pole is coupled to a second portion of the leading pole, an outer diameter of the intermediate pole is greater than an outer diameter of the leading pole; and a first base plate comprising a plurality of slots located along the outer diameter of the first base plate, wherein:

the first base plate is disposed about a second portion of the intermediate pole; and the first base plate is flush with an end of the intermediate pole.

16. The system of claim 15, further comprising a utility pole comprising:

a second base plate comprising a plurality of slots located along the outer diameter of the second base plate, wherein the second base plate is flush with an end of the utility pole, and wherein the first base plate is coupled to the second base plate using a plurality of fasteners.

17. The system of claim 16, wherein the fasteners include a breakaway features configured to shear upon impact above a predetermined threshold.

18. The system of claim 16, wherein each of the fasteners comprises:

a first pair of nuts configured to engage a slot from among the plurality of slots located on the first base plate; and a second pair of nuts configured to engage a slot from among the plurality of slots located on the second base plate.

19. The system of claim 16, wherein a surface of the first base plate is in direct contact with a surface of the second base plate.

20. The system of claim 16, further comprising a shear plate disposed between the first base plate and the second base plate, wherein the shear plate is configured to shear in response to a force above a predetermined threshold applied to the shear plate.

* * * * *